250-506.1 SR
OR 4,234,798 6,1

United Sta
Baatz et al.

[11] 4,234,798
[45] Nov. 18, 1980

[54] TRANSPORT AND STORAGE RECEPTACLE FOR RADIOACTIVE WASTE

[75] Inventors: Henning Baatz, Essen; Dieter Rittscher, Heiligenhaus, both of Fed. Rep. of Germany

[73] Assignee: Steag Kernenergie GmbH, Essen, Fed. Rep. of Germany

[21] Appl. No.: 940,098

[22] Filed: Sep. 6, 1978

[30] Foreign Application Priority Data

Sep. 7, 1977 [DE] Fed. Rep. of Germany ..... 7727690

[51] Int. Cl.² ..... G21F 5/00
[52] U.S. Cl. ..... 250/506; 250/515
[58] Field of Search ..... 250/506, 507

[56] References Cited

U.S. PATENT DOCUMENTS 3,113,215 12/1963 Allen ..... 250/506
3,175,087 3/1965 Aupetit ..... 250/507
3,414,727 12/1968 Bonilla ..... 250/506

OTHER PUBLICATIONS

Gamma Ray Shielding (National Lead Products), p. 7, 1972.

*Primary Examiner*—Harold A. Dixon
*Attorney, Agent, or Firm*—Karl F. Ross

[57] ABSTRACT

A transport and storage receptacle for radioactive waste, capable of shielding the environment from radiation, comprises a vessel shell, bottom and cover. The shell and bottom are cast in one piece from cast iron (especially spherolytic cast iron) or cast steel and the cover is a shielding cover which can be recessed in the shell. The wall of the vessel is formed unitarily with at least one passage which communicates with the bottom of the chamber receiving the waste and terminates in an end wall along the upper face of the receptacle which can be provided with a separate closure for this passage.

8 Claims, 2 Drawing Figures

TRANSPORT AND STORAGE RECEPTACLE FOR RADIOACTIVE WASTE

CROSS REFERENCE TO RELATED APPLICATIONS

This application is related to our co-pending applications Ser. Nos. 875,079 and 903,093 filed Feb. 3 and May 5, 1978 respectively.

FIELD OF THE INVENTION

The present invention relates to a transport and storage receptacle for radioactive waste and, more particularly, to an enclosure for radioactive waste which is capable of preventing penetration of radioactivity into the ambient environment.

BACKGROUND OF THE INVENTION

In modern technology it is frequently necessary to transport and store radioactive materials, such as radioactive wastes, in small units, such that the radioactivity in these materials does not escape into the environment.

The canisters, containers, receptacles or enclosures used for this purpose should generally be of a sort which enables them to be transported or moved around and the receptacles must be of a material capable of absorbing radioactivity in particular of acting as a neutron absorber.

Various receptacles and receptacle configurations have been provided for this purpose and can be used particularly for the shielding storage and transport of radioactive waste, such as spent nuclear fuel elements, nuclear fuel residues and the products of nuclear fuel reclaiming plants. It is known, for example, to provide a transport or storage receptacle for radioactive waste, especially nuclear reactor fuel elements, which comprises a receptacle shell, a receptacle bottom and a cover for the chamber surrounded by the shell and closed at its face by the bottom.

More specifically, in this earlier system, the receptacle shell and receptacle bottom is cast in one piece (unitarily) from metal especially cast iron or cast steel, the cast iron being generally spherolytic cast iron. Such substances have a high neutron absorption cross section.

The cover can be a shielding cover, i.e. can have a portion which is recessed in the wall of the receptacle so that any gaps between the cover and the wall are labyrinthine in configuration, thereby, precluding a straight-line path for the escape of radiation.

Naturally, the thickness of our receptacle wall or shell, of the bottom and of the shielding cover, measured perpendicular to the surface defining the storage compartment or chamber for the radioactive waste must be sufficient enable the receptacle to withstand the static or dynamic stress to which the receptacle may be subject during transport or storages and, in addition, must be sufficient to prevent any escape of the radiation to the exterior whether the radiation is gamma rays or neutron emissions.

In conventional systems of the above described type, servicing of the receptacles is a problem since access parts and fittings are provided on various sides of the receptacles so that operations which must be carried out necessitate manipulating the vessel.

Furthermore, it is frequently desirable to provide such receptacles in conjunction with apparatus for the processing of radioactive waste or other materials. The apparatus can be of various types and connection of the receptacle to such apparatusses must be afforded (see German Patent Application-Offenlegungsschriften-DT-OS Nos. 25 11 957 and 25 20 850. With such systems, the conventional receptacles cause problems because of the complex connections which may be necessary.

OBJECT OF THE INVENTION

It is the principal object of the present invention to provide a storage receptacle for radioactive waste which provides the disadvantages of earlier systems and enables a simplified handling of the receptacles under the system described above.

Another object of the invention is to provide a receptacle suitable for the transport and storage of radioactive material and which is free from the drawbacks of earlier systems for this purpose can be used more easily in conjunction with apparatusses of various types and affords greater ease of handling and treatment of the material within such a receptacle.

SUMMARY OF THE INVENTION

These objects, and others which will become apparent hereinafter are attained in accordance with the present invention in a receptacle for the shielding storage and transport of radioactive waste in which all of the elements and components for service and access to the contents of the vessel are disposed on one side of the vertical prismatic body, namely the upper face thereof, thereby enabling the vessel to be filled simply and to be handled readily, permitting the vessel to be connected to an apparatus in a convenient manner, and allowing the processing of the contents of the vessels with ease.

According to the invention, the vessel comprises a thick vertical wall structure and is generally prismatic, i.e. of rectangular parallele pipedal configuration with the vertical wall being unitary with the base and cast in one piece therewith from cast iron, especially spherolytic cast iron, or steel, a removable cover, having a thick shielding portion which is received in the chamber or compartment formed by the wall and the bottom of the container and accommodating the radioactive waste.

According to an essential feature of the invention, passage is formed in situ by casting in the body constituted by the wall and the bottom of the receptacle and connects with the interior of the vessel at a low point of the chamber, this passage running to the upper end face of the body at which means is provided to close this passage.

The passage can be formed by enbedding a tube in the cast material of the body.

The closure means along the top face of the body can be a special cover provided exclusively to close this passage and removably connected to or forming part of the shielding cover.

In a preferred embodiment of the invention, however the closure means it is a separate cover, which overlies the shielding cover of the receptacle, the latter cover being recessed in the upper end face of the body.

In the best mode currently known to us for carrying the invention in practice, the additional or passage cover overlies the shielding cover and is also recessed in the end face of the body.

Both covers may be connected to the body by screws, bolts or clamping devices.

In the best-mode embodiment of the invention, moreover, an additional passage can be cast or formed in situ in the wall of the body and connects with the waste-receiving chamber at the upper end thereover, i.e. immediately below the shielding cover while running to the upper face or end of the body. This further passage may also be formed by a tube which is imbedded in the cast iron or steel of the body.

The additional passage may also be closed by a separate cover which is removable although it is preferred to close it with the additional or passage cover referred to above. When the additional cover is connected to the shielding cover, it maybe constituted as a flange thereof, although in the preferred embodiment of the invention, it is a separate element.

The passages which are provided in accordance with the present invention allow water which may be introduced into the storage chamber or compartment to be sucked out during the filling from the filling side of the vessel. It has also been found adventageous to use the two passages for the circulation of a coolant through the storage chamber to dissipate the heat generated by fission of the radioactive material or by radioactive decay or to enable of body of coolant to permit heat transfer to the wall of the vessel.

Naturally, using the principles set forth, still other passages can be formed in the body for any desirable treatment or servicing purpose.

When the radioactive waste is highly neutron emission, the invention provides that the tube or tubes cast suitable in the wall of the vessel can be located at an inner portion of the wall, i.e. the inner half of the thickness thereof, while shielding or moderating material of high neutron-capture cross section is disposed along an outer portion (half) of the thickness of the wall. This outer portion of the thickness of the wall can be formed with chambers which are filled with the moderating material. These chambers can be formed as simple bores although they are preferably of oval cross section and are disposed so that straight-line radiation from the interior of the vessel is always intercepted by the moderating or shielding material. The moderating material can also be retained in tubes which are closed at the bottom and embedded in the aforementioned body.

When the evolution of heat as a result of radioactive instability is considerable, it is advantageous to provide outer surfaces of the body, at least between the bottom and the cover of the vessel with cooling ribs which advantageously run vertically and are spaced apart about the perimeter of the vessel. The mutually parallel coding ribs, which are cast in one piece with the remainder of the body, can be interruppted by gaps to facilitate thermal expansion and contraction and improved heat transfer to ambient air. Alternatively the cooling ribs can run circumferentially or peripherally.

The interruptions in the cooling ribs have been also found to facilitate dimensional changes during the casting process.

The principal advantage of the system of the present invention is that it facilitates the filling of the vessel without complex apparatus and without the need for expensive hand-operated instruments or units. Venting, cooling, draining, filling and like elements of the apparatus can be connected at the same end as that at which filling takes place without danger to personnel. Personnel safety is thus increased since all of the access is at one and the same end and the thickness of the body can be relatively great.

The inner chamber is so dimensioned that it can receive four fuel elements of a pressurized water reactor or sixteen elements of a boiling water reactor. The closing ribs, more over, dissipate sufficient heat that the cans or tubular containment of the fuel elements are not destroyed or damaged by the heat which is involved.

BRIEF DESCRIPTION OF THE DRAWING

The above and other objects, featuring and advantages of the present invention will become more readily apparent from the following description, reference being made to the accompanying drawing in which.

SPECIFIC DESCRIPTION

Figure 1:
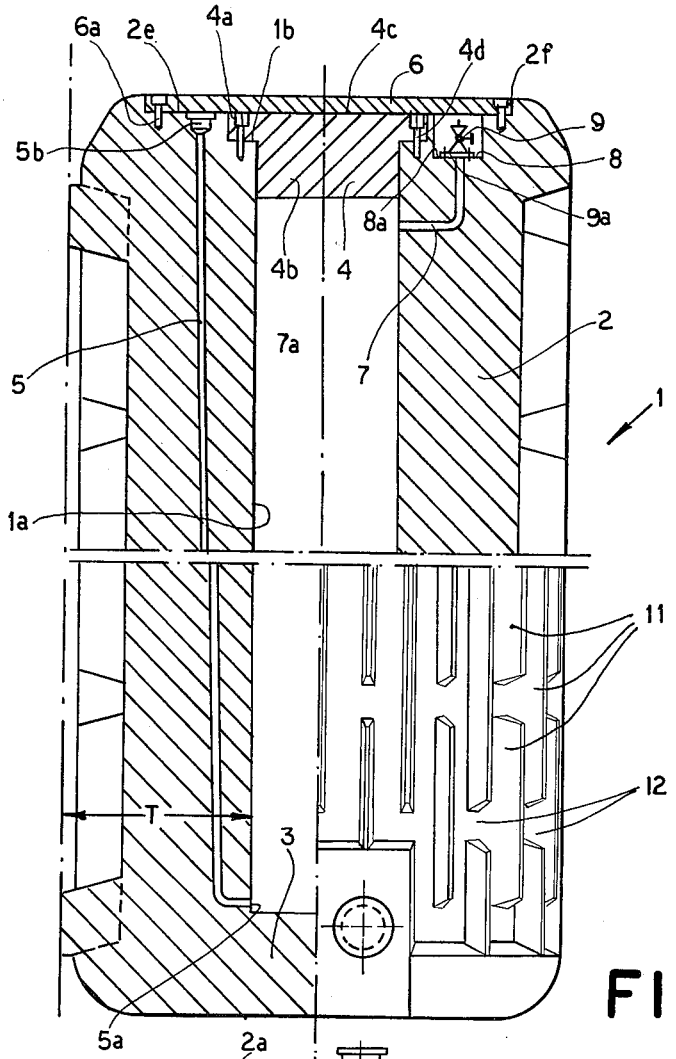
FIG. 1 is a vertical cross sectional view of receptacle according to the invention, partly broken away.

The shielding transport and storage container illustrated in the drawing and represented generally at 1 is formed with a vertically elongated compartment 1*a* adapted to receive irradiated nuclear fuel elements. Naturally, the chamber can also receive other radioactive wastes as may be required.

Basically, the container or receptacle comprises a container wall or shell 2, a bottom 3 and a cover as will be described in greater detail below.

According to the invention, the wall 2 laterally surrounding the chamber 1*a*, and the bottom 3 of the container are cast in one piece from cast iron, especially spherolytic cast iron, cast steel or the like.

The receptacle is generally prismatic and of the configuration of a rectangle parallele-pipedon with rounded edges, i.e. has vertical faces 2*a* and 2*b* which are parallel to one another and vertical faces 2*c* and 2*d* which are also parallel to one another but are perpendicular to the faces 2*a* and 2*b*. The upper and lower end faces of the receptacle are also flat.

The chamber 1*a* for receiving the radioactive waste, is formed with a shoulder 1*b* at its upper end upon which rests a lateral flange 4*a* of a shielding cover 4. Surrounded by this flange is a block 4*b* of shielding material which plugs the upper end of the chamber 1*a*, the cover 4 being recessed in the body formed by the wall 2 and the bottom 3 so that its upper surface 4*c* lies flush with an end face 2*e* of this body.

According to the invention, the vessel wall 2 is provided in situ, i.e. during the casting process, with a tubular passage 5 which communicates between the low point 5*a* of the chamber 1*a* and the face 2*e* of the body 2, 3.

To close this passage 5 at its upper end, which can be formed with an internally threaded formation 5*b* for connection to a pipe, the receptacle 1 is provided with a passage cover which is generally represented at 6. The latter is wholly received in a recess 2*f* formed at the upper end of the container.

In the embodiment illustrated, the cover 6 not only closes the passage 5*b*, 5, but also overlies the cover 4.

Bolts or screws 6*a* are threaded into the body 2, 3 and screws 4*d* passing through the flange 4*a* secure the cover 6 and 4 in place.

In the bestmode embodiment of the invention, a further tubular passage 7 is cast in situ within the body 2, 3, the passage 7 communicating at 7*a* with the chamber 1*a* at its upper end, i.e. just below the plug 4*b*. At its opposite end, the passage 7 opens into a compartment 8 recessed in this body and terminates flush with the bottom 8*a* of this compartment. A valve 9 can have a flange 9*a* which is screwed to the body so as to sealingly couple this valve with the passage 9. The valve 9 is wholly received in the compartment 8 which, in turn, is closed by the cover 6. Thus the cover 6 is screwed to the body 2, 3 outwardly of the regions in which the passages 5 and 7 open at the surface 2*e* of the body.

The valve 9 may be a fluid control valve or a pressure relief or safety valve which can be vented, e.g. through an additional tube.

Figure 2:
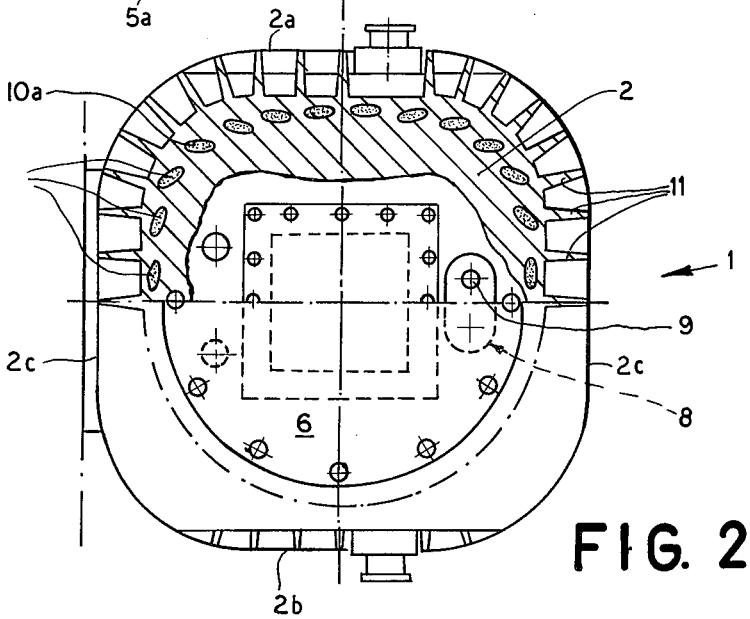
FIG. 2 is a plan view of the receptacle of FIG. 1, also partially in section.

As is apparent from FIGS. 1 and 2, the passages 5 and 7 lie within the inner half of the thickness T of the wall 2. This permits the outer half of the wall thickness to receive passages 10 which, as shown in FIG. 2, are of oval cross section and extend the full length of the vessel. These passages receive radiation shielding material 10*a*, e.g. graphite or some other neutron moderator or a heavy metal such as lead. The additional moderator 10*a* is especially advantageous when the radioactive wastes have a high neutron emission.

The channels 10 can also be closeable by the cover 6. Of course, the cover 4, 6 can be connected together e.g. by screws.

The outer periphery of the receptacle is provided with cooling ribs 11 which are cast in situ and in one piece with the body 2, 3. The ribs 11 are shown to extend along generatrices of the body and to have gaps or cutouts 12 which facilitate expansion and contraction. Naturally, the ribs may also lie in horizontal planes as desired.

We claim:

1. A shielding transport and storage receptacle for radioactive materials, especially for nuclear-reactor fuel elements, comprising:

an elongated body cast in one piece and formed with a lateral wall surrounding a chamber for said material and a bottom, said body being composed of cast iron or cast steel;

a shielding cover connected to said body and closing said chamber at an upper end thereof with a thickness of radiation absorbing material limiting escape of radiation into the environment, at least one passage cast in said body and communicating with said chamber at a low point thereof, said passage terminating at an upper end of said body;

means including an additional cover removably affixed to said body for closing said passage at said end of said body; and a further passage cast in said body and communicating with said chamber at an upper portion thereof, said further passage terminating at said end, means being provided for closing said further passage, the means for closing said further passage being said additional cover.

2. The receptacle defined in claim 1 wherein said body is formed along said wall with outwardly extending mutually parallel cooling ribs interrupted by gaps.

3. The receptacle defined in claim 1 wherein said body has a greater wall thickness at said end than elsewhere along said body.

4. The receptacle defined in claim 1 wherein said ribs are cast in one piece with said body.

5. A shielding transport and storage receptacle for radioactive materials, especially for nuclear-reactor fuel elements, comprising:

an elongated body cast in one piece and formed with a lateral wall surrounding a chamber for said material and a bottom, said body being composed of cast iron or cast steel;

a shielding cover connected to said body and closing said chamber at an upper end thereof with a thickness of radiation absorbing material limiting escape of radiation into the environment;

at least one passage cast in said body and communicating with said chamber at a low point thereof, said passage terminating at an upper end of said body;

means including an additional cover removably affixed to said body for closing said passage at said end of said body; and a further passage cast in said body and communicating with said chamber at an upper portion thereof, said further passage terminating at said end, said passages being formed in the inner half of the thickness of said body and the outer half of the thickness thereof around said chamber being provided with a plurality of channels receiving a radiation moderator material, said channels being closed by said additional cover.

6. The receptacle defined in claim 5 wherein said body is formed along said wall with outwardly extending mutually parallel cooling ribs interrupted by gaps.

7. The receptacle defined in claim 5 wherein said body has a greater wall thickness at said end than elsewhere along said body.

8. The receptacle defined in claim 5 wherein said ribs are cast in one piece with said body.

* * * * *